US005816715A

United States Patent [19]

Harman et al.

[11] Patent Number: 5,816,715

[45] Date of Patent: Oct. 6, 1998

[54] SYSTEM AND METHOD FOR BUFFERING MATERIALS THAT ARE PRODUCED AT TWO DIFFERENT RATES OF SPEED

[75] Inventors: James L. Harman, Southport; Wesley A. Kirschner; Michael J. Ramadei, both of Trumbull, all of Conn.

[73] Assignee: Pitney Bowes Inc., Stamford, Conn.

[21] Appl. No.: 743,771

[22] Filed: Nov. 7, 1996

[51] Int. Cl.[6] ..... B41J 3/42

[52] U.S. Cl. ..... 400/71; 271/2; 271/306; 270/52.02; 395/104

[58] Field of Search ..... 400/71, 82, 52; 271/199, 306, 2; 270/52.02; 395/104

[56] References Cited

U.S. PATENT DOCUMENTS

| | | | |
|---|---|---|---|
| 4,544,146 | 10/1985 | Zemke et al. | 270/52.02 |
| 5,043,749 | 8/1991 | Punater et al. | 101/483 |
| 5,324,025 | 6/1994 | Chadwick et al. | 271/306 |
| 5,429,349 | 7/1995 | Supron et al. | 271/199 |
| 5,559,606 | 9/1996 | Webster et al. | 395/114 |
| 5,628,249 | 5/1997 | Cordery et al. | 400/82 |

*Primary Examiner*—Eugene H. Eickholt
*Attorney, Agent, or Firm*—Ronald Reichman; Melvin J. Scolnick; Robert Meyer

[57] ABSTRACT

This invention utilizes a simple mechanical buffer that will hold material and a two stage software buffering technique that controls the mechanical buffer to act as a First In First Out mechanical mechanism that allows other system events to be triggered off of dynamic thresholds. The two stage software buffering technique consists of a simple software FIFO with rule based logic to control input into a primary queue input and a secondary reserve queue which holds information as soon as it arrives. The decision to move information from the secondary reserve queue into the primary queue is based upon specific rules that are dynamically executed. This permits the creation of a dynamic threshold and allows the reliable triggering of the systems events. The foregoing permits material that is being produced at one fixed speed to be synchronized with material that is produced at variable speeds. The foregoing also permits a first document laser printer that has a constant printing time and a second envelope printer that has a variable print time to be synchronized. Thus, the document may be printed with a laser printer and the envelope printed with an ink jet printer.

12 Claims, 11 Drawing Sheets

C
95
ENVELOPE ARRIVES
96
IS ENVELOPE JAMMED ?
YES
97
ENVELOPE IN BUFFER ?
NO
YES
REPORT JAM
122
NO
TRANSMITS SAFE TO PRINT
98
SPIN SLOTTED BUFFER
99
100
SHORT JOB ?
YES
NO
SPIN BUFFER UNTIL ENVELOPE AT BOTTOM
101
NO
BUFFER FULL ?
102
B
YES
BUFFER WAIT UNTIL INSERTER NEEDS ENVELOPE
103
D

D
TRANSMITS SAFE TO PRINT
104
SPIN BUFFER
105
106
ENVELOPE BOTTOM ?
NO
107
REPORT JAM
YES
SEND ENVELOPE TO INSERTER
108
109
LAST PIECE IN BUFFER ?
NO
B
YES
120
ENVELOPE STILL JAMMED ?
YES
121
REPORT JAM
NO
C

SYSTEM AND METHOD FOR BUFFERING MATERIALS THAT ARE PRODUCED AT TWO DIFFERENT RATES OF SPEED

FIELD OF THE INVENTION

The invention relates generally to control systems, and more particularly to a system that needs to buffer and synchronize two different materials that are being supplied to a system at two different rates.

BACKGROUND OF THE INVENTION

Mechanical manufacturing systems have been developed that use materials that are produced by different parts of the system. For instance, systems for producing mailpieces include a first printer for printing a document and a mail finishing unit for receiving the document from the first printer and inserting the document into an envelope to form a mail piece. The mail finishing unit includes a second printer for printing an address on the envelope prior to insertion of the document into the envelope. Mechanical buffers were utilized by the prior art to synchronize the delivery of a first material i.e., envelope to the delivery of a second material i.e., document to another subsystem i.e., inserter that uses the first and second materials.

When the first material was produced at a first fixed rate of speed and the second material was produced at a second fixed rate of speed, mechanical buffers were able to synchronize the feeding of the first and second materials to another subsystem. However, when the first and/or second material was not produced at a fixed rate of speed mechanical buffers were unable to synchronize the delivery of the first and second materials to a subsystem. An example of the foregoing is that the amount of time to print different envelopes would be variable (the number of characters in the address would not be constant) and the amount of time to print a document may or may not be variable (the number of characters in the documents may or may not be constant).

Ink jet printers have a variable print time that depends upon the amount of data and location of where the data is printed. Thus, if an ink jet printer was used as a printer for printing the envelope and/or document synchronizing problems would be present. Thus, mechanical buffers did not provide full functionality because they were incapable of synchronizing materials that were produced at variable speeds.

The envelope had to be at the inserter in time for the document to be inserted into the envelope. If the envelope and document were not placed at the inserter at the correct time the system would be out of synchronization and a paper jam would likely occur. The jammed paper would have to be removed before the system could continue its operation.

First In First Out (FIFO) mechanical mechanisms have been developed that deliver materials in at one speed and take materials out at another speed. First in first out mechanisms are expensive, difficult to design and to control.

Software buffering techniques have been developed to construct software FIFO's. One of the problems encountered in using software FIFO's is that they are unable to effectively handle delays in the input data and reliably trigger other system events without some intelligence that dynamically controls how much information should be sent to the software FIFO at a given time. The software FIFO would match the rate of delivery of one system to the required rate of delivery of the other system. Without controlling the rate of information being placed into the software FIFO the size of the software FIFO may become large and expensive or run the risk of not having information available when it is needed. The trigger level of how much information is in the required software FIFO varies depending on the mode of operation of the machine and the ability to synchronize other system events off of that trigger level.

Software FIFO's that control the triggering of other system events, operate well when the system is static or constant, i.e., an event is triggered when three items are left. It was difficult for software FIFO's to trigger other system events when the amount of information in the FIFO was changing and the threshold which triggered that event was dynamic.

SUMMARY OF THE INVENTION

This invention overcomes the disadvantages of the prior art by providing a simple mechanical buffer i.e. shift register type that will hold material and a two stage software buffering technique that controls the mechanical buffer to act as a First In First Out mechanical mechanism that allows other system events to be triggered off of dynamic thresholds. The two stage software buffering technique consists of a simple software FIFO with rule based logic to control input into a primary queue input and a secondary reserve queue which holds information as soon as it arrives. The decision to move information from the secondary reserve queue into the primary queue is based upon specific rules that are dynamically executed. This permits the creation of a dynamic threshold and allows the reliable triggering of the systems events.

The foregoing permits material that is being produced at one fixed speed to be synchronized with material that is produced at variable speeds. The foregoing also permits a first document laser printer that has a constant printing time and a second envelope printer that has a variable print time to be synchronized. Thus, the document may be printed with a laser printer and the envelope printed with an ink jet printer.

This two stage software scheme with its rules based control can compensate for information arriving into the system that is non-deterministic, i.e., information that arrives in bursts with gaps in input activity.

Information entering the system is time division multiplexed into three categories. The first category is document data that is printed by a first document laser printer and the second category is envelope data that is printed by a variable print time ink jet printer. The third category is control information that determines how to construct the mail piece i.e., how to fold the document, insert other inserts into the envelope, whether or not to seal the envelope, etc.

Depending on the task, the printer that prints the document and the printer that prints the envelope may be faster or slower than the other. However, a ink jet printer will always have a variable print time and a laser printer will have a fixed print time. The interpretation time of the laser printer may vary.

A system with the control mechanism described herein can readily adapt at run-time to be either a mailing machine that is paced by a laser printer or a system that is paced by an envelope printer. The detection and switching between modes is automatic and the rules that affect the reserve queue operation can be dynamically switched to optimize for new modes. Once the system has the ability to dynamically alter its control mechanism and switch from being driven by the fixed print time laser printer to the variable print time envelope printer or vice-versa, it is relatively easy for the system to also compensate for the variable arrival of data. For example, the system can be controlled with a relatively simple mechanical buffer, (that includes a plurality of holding slots) that is placed after the envelope printer. Whereas, the prior art would use a more complex mechanical FIFO mechanism.

The first stage software FIFO tracks the information that is printed on envelopes stored in the mechanical buffer i.e., logically overlaps it. In other words, the physical mechanical buffer contains printed envelopes and the first stage software FIFO contains a data embodiment of the information printed on the envelopes. The entry of the envelope from the envelope printer into the mechanical buffer is controlled by a set of rules. For example, if the system is paced by the laser printer, the envelope printer is given a full mechanical slot cycle time to complete its task. If the envelope printer needs less than or equal to the allocated slot cycle time to complete its task, the envelope printer is in effect "synchronized" to the laser printer. In other words the envelope printer is prevented from printing faster than the laser printer. If the envelope printer needs more than one slot time to complete its task, the envelope printer is prevented from entering the mechanical buffer. The committing of additional printed laser sheets is lengthened in time to effectively slow the speed of the laser printer down to the speed of the envelope printer.

In the event bursty data enters the system in a non-deterministic manner, the situation may become a bit more complicated. For example, the dynamic threshold would be kept high enough to deliver information to the envelope printer, when needed, to keep the slotted mechanical buffer as full as possible. The foregoing dynamic threshold would also be used to trigger the committing of sheets to the laser printer. Thus, the envelope printer and the laser printer gracefully slow down to match the average rate of data arrival. Furthermore, as the data delays, are reduced, the system will adapt again and operate at its full throughput, being paced by either the laser printer or the envelope printer, whichever is slower.

DETAILED DESCRIPTION OF THE PREFERRED EMBODIMENT

Figure 1:
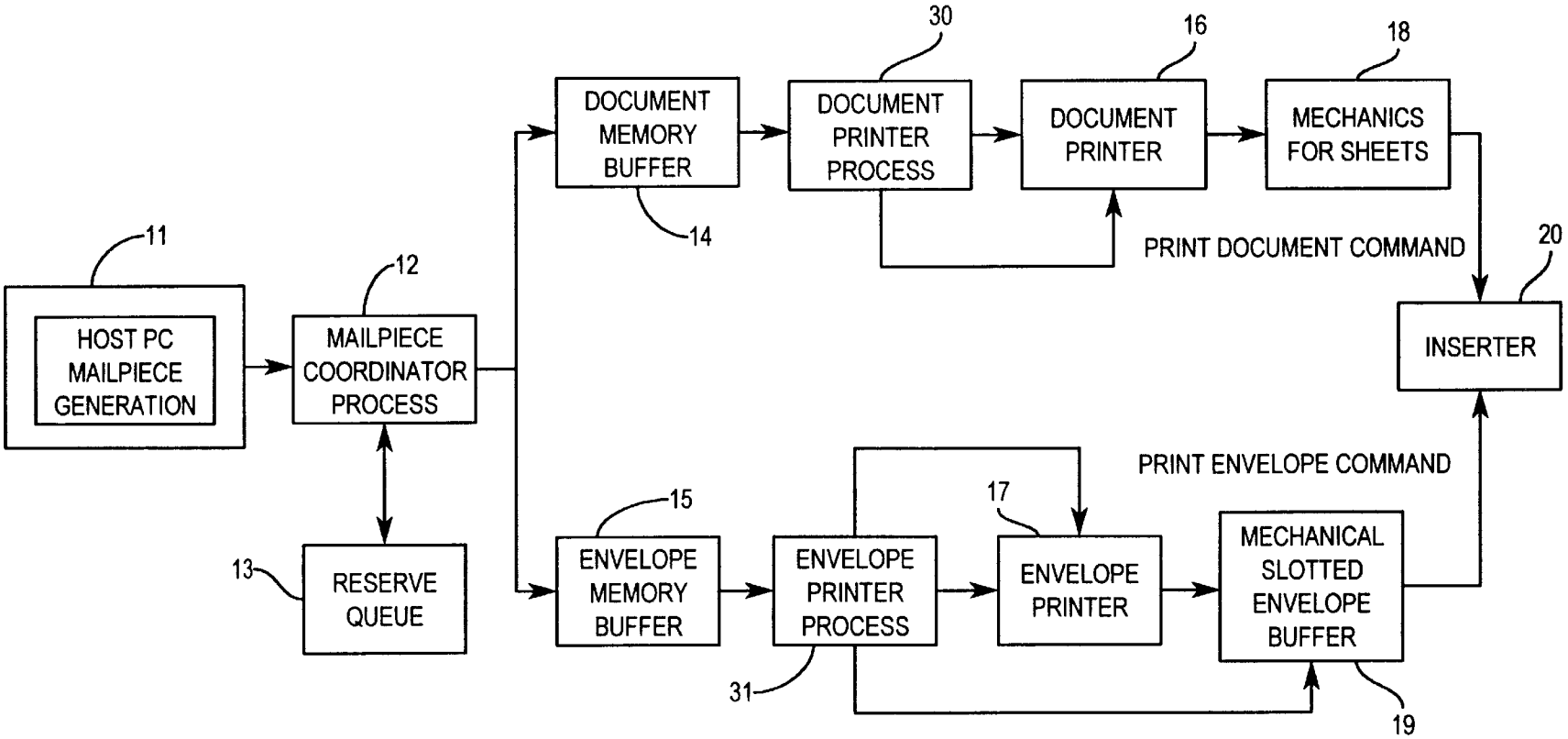
FIG. 1 is a block diagram of the apparatus of the invention.

Referring now to the drawings in detail and more particularly to FIG. 1, the reference character 11 represents a computer that contains a program for the generation of mail stream data i.e., the generation of a letter with an envelope having the same address as the letter. An example of programs for the generation of mail stream data are: Microsoft's Word For Windows and Corel's Word Perfect. Computer 11 outputs variable data in a non-deterministic manner to the input of mailpiece coordinator microprocessor 12. Microprocessor 12 contains: the rules for envelope transfer; when the laser printer will print additional sheets; and when the envelope printer will print additional envelopes. The software that controls microprocessor 12 will be more fully described in the description of FIGS. 3A–3E. Microprocessor 12 is coupled to reserve queue 13, document memory buffer 14; and envelope memory buffer 15. Queue 13 is a software FIFO that holds envelopes that microprocessor 12 has not yet committed to be printed. The software that controls queue 13 will be more fully described in the description of FIGS. 3A, 3B and 3E.

The output of envelope buffer memory 15 is coupled to the input of envelope printer process 31. The output of envelope printer process 31 is coupled to the input of envelope printer 17 and the input of mechanical slotted envelope buffer 19. The output of printer 17 is coupled to one of the inputs of mechanical slotted envelope buffer 19. The output of buffer 19 is coupled to inserter 20. The output of document buffer memory 14 is coupled to the input of document printer process 30. The output of printer process 30 is coupled to the input of document printer 16 and the output of printer 16 is coupled to the input of sheet mechanics 18. The output of mechanics 18 is coupled to inserter 20.

Document memory buffer 14 holds document data for document printer 16 The held data is for sheets that microprocessor 12 has not yet committed to be printed. Document printer 16 is a typical laser printer that has the characteristics of a variable start up time and a fixed print out time. Thus, printer 16 will receive data from buffer 14 and commands for the time for printing of the data from microprocessor 12. After printer 16 prints a sheet of paper, mechanics for sheets 18 accumulates the sheets and folds the sheets. An example of a mechanism that accumulates is the Pitney Bowes Inc. Spectrum F 400.

Envelope memory buffer 15, which is also the first stage of the FIFO holds envelope data for envelope printer 17. The held data is for envelopes that microprocessor 12 has not yet committed to be printed. Envelope printer 17 is a printer that has the characteristics of a variable start up time and a variable print out time. Thus, printer 17 will receive data from buffer 15 and commands for the time for printing of the data from microprocessor 12. After printer 17 prints a envelope, the envelope will be placed in mechanical slotted envelope buffer 19. Buffer 19 is used as a synchronizing element to buffer and remove the variable print time effect of envelope printer 17 from the effects of sheets of paper from mechanism 18 arriving at inserter 20 at a constant rate. Buffer 49 is also used to hold the printed envelopes while the ink dries. Mechanical buffer 19 will be more fully described in the description of FIG. 2. Inserter 20 will receive envelopes from buffer 19, open the envelopes and insert the folded sheets of paper that it received from mechanics 18 into the envelopes.

Figure 2:
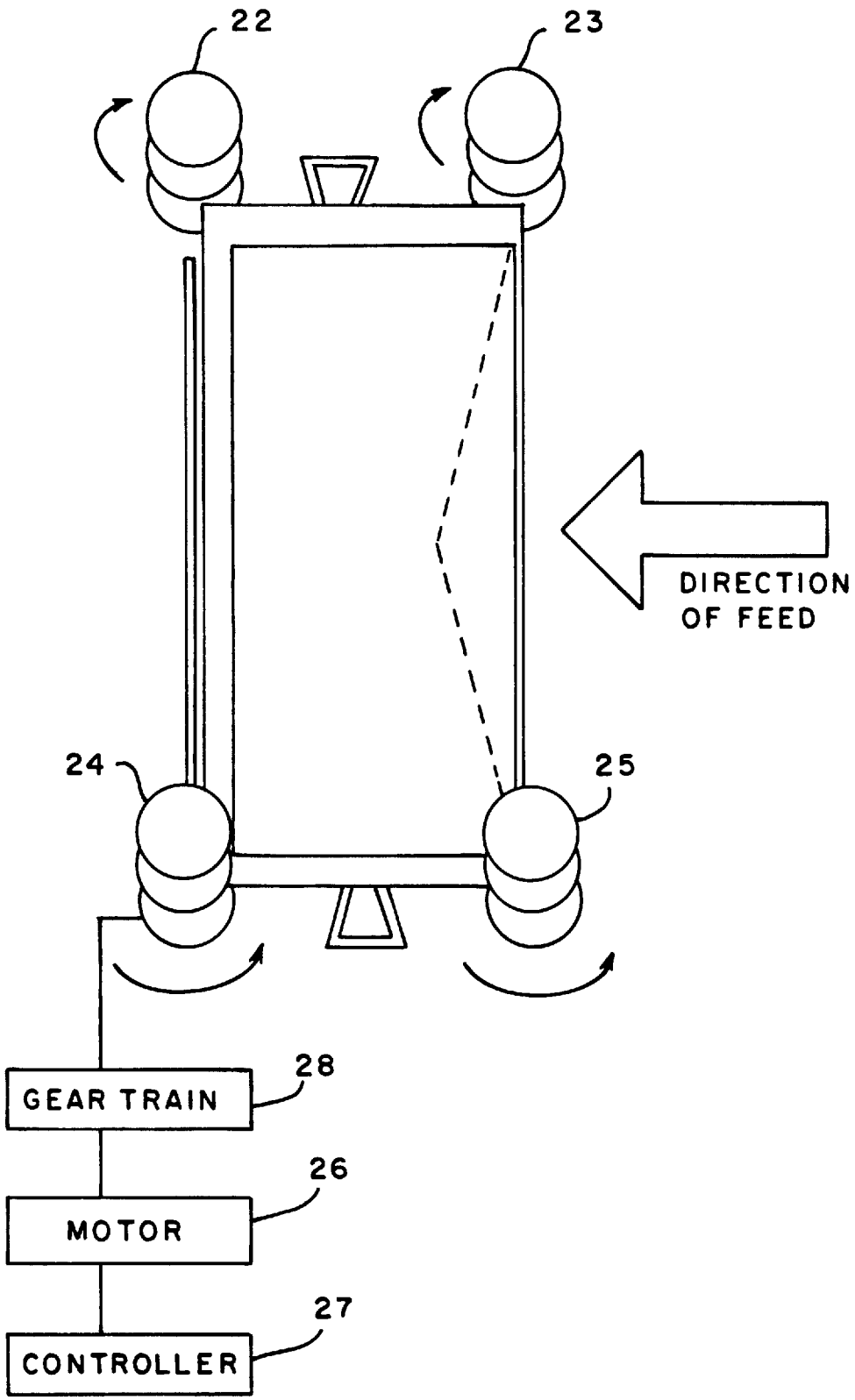
FIG. 2 is a diagram of mechanical slotted envelope buffer 19.

FIG. 2 is a diagram of mechanical slotted envelope buffer 19. Buffer 19 includes: four helical shaped screws 22, 23, 24 and 25; motor 26; controller 27 and gear train 28. Screws 22, 23, 24 and 25 have threads that are capable of holding a plurality of envelopes. An envelope is held by the thread of screw 22, 23, 24 and 25 that is at the same height. Motor 26 and controller 27 causes gear train 28 to turn screws 22, 23, 24 and 25 one complete revolution at a time. Controller 27 is controlled by microprocessor 12. The foregoing allows one envelope in buffer 19 to exit one of the threads of screws 22, 23, 24 and 25 and an envelope printed by printer 17 to enter one of the threads of screws 22, 23, 24 and 25. Thus, mechanism 19 insures that the envelopes exit buffer 19 in the same order that they entered buffer 19.

Figure 3A:
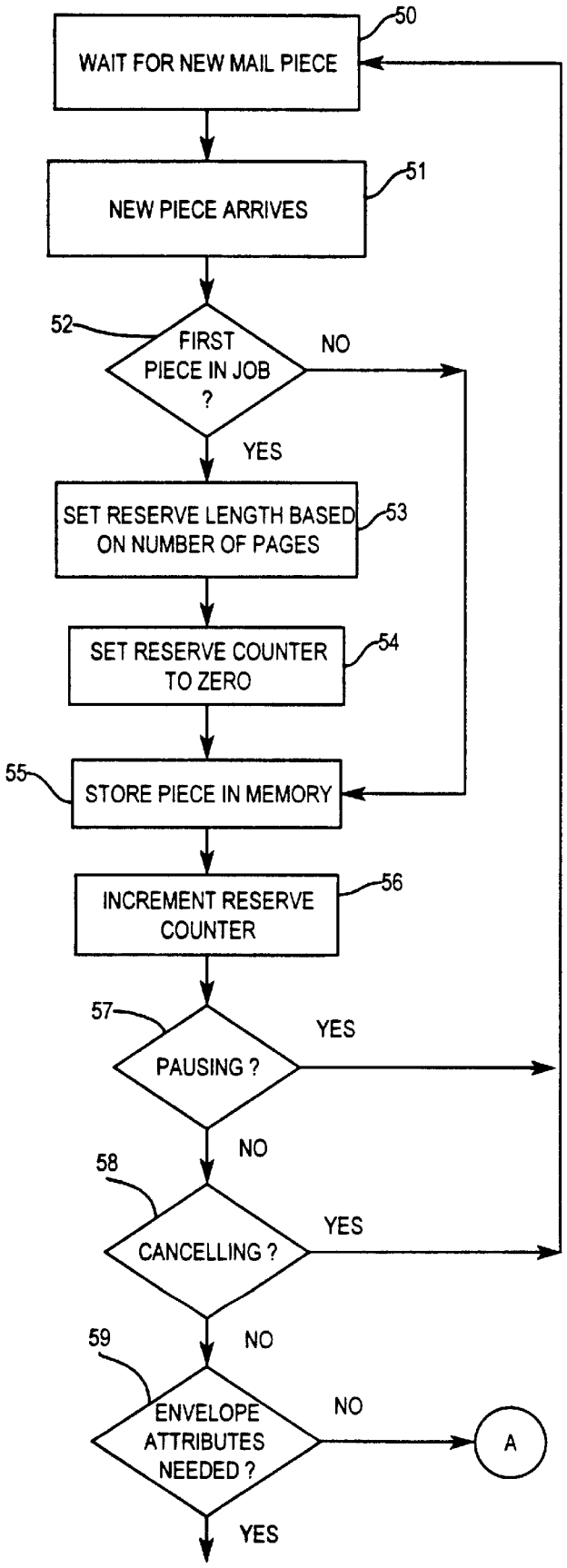
FIGS. 3A and 3B are flow charts showing the processing of mailpiece attributes.
Figure 3B:
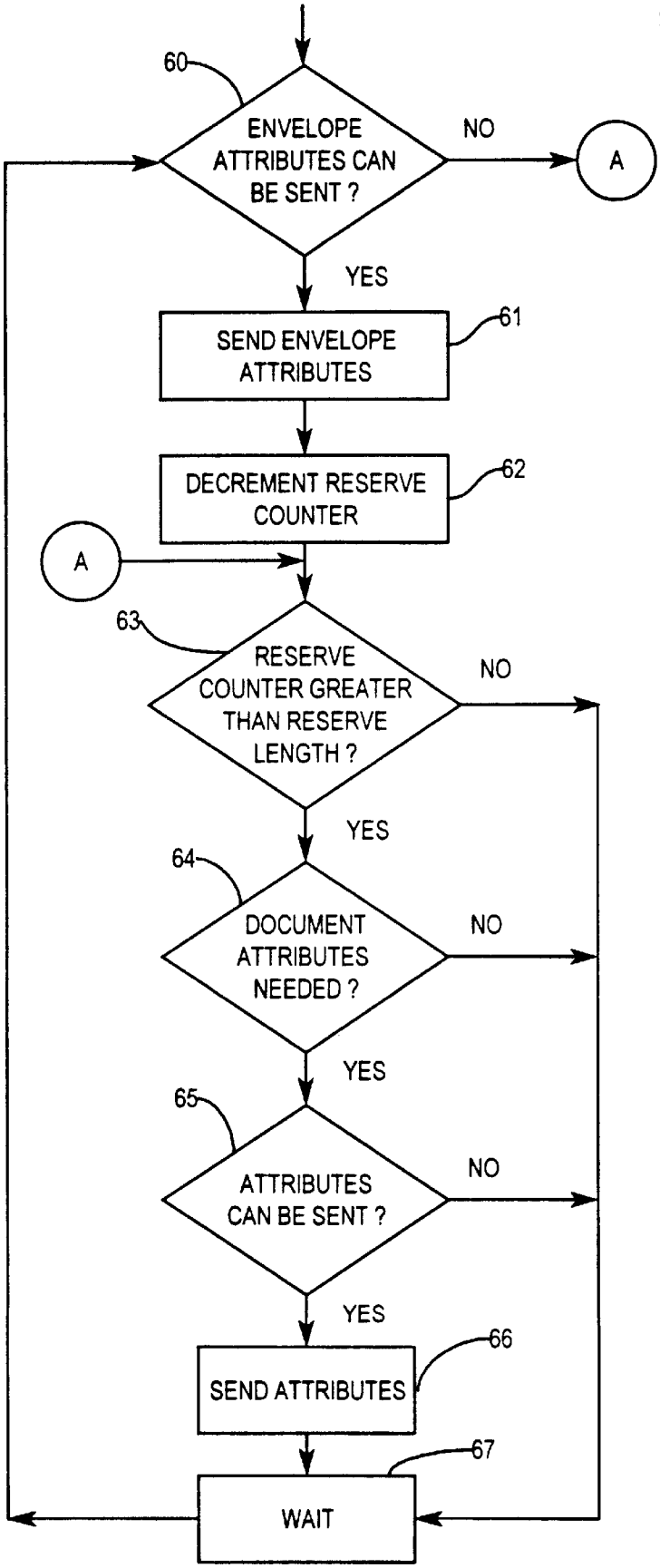

FIGS. 3A and 3B are flow charts showing the processing of mail piece attributes. The program begins in block 50 entitled "wait for new mail piece". Then the program goes to block 51 new mail piece arrives at process 12 (FIG. 1). Then, the program proceeds to decision block 52 first mail piece in job. If block 52 determines that it is not the first mail piece in the job, then the program proceeds to block 55 store mail piece in memory. If block 52 determines that it is the first mail piece in the job, then the program goes to block 53 set reserve length based upon the number of pages in queue 13 (FIG. 1). The length of queue 13 is determined by the number of pages in the mail piece. Now the program goes to block 54 set reserve counter to zero. Then, the program proceeds to block 55 store mail piece attributes in memory. The attributes are the address, the fold, type, seal mode, the number of pages etc. Then, the program proceeds to block 56 increment reserve counter by one. Then, the program proceeds to decision block 57 entitled "pausing". If block 57 determines that the system wants to pause, i.e. determines that the system temporarily wants to stop generating mail, the program proceeds back to block 50 to wait for a new mail piece. If block 57 determines not to pause, then the program proceeds to decision block 58 canceling. If block 58 determines that the system wants to quit the job in progress or start another job, then the program proceeds back to block 50 to wait for a new mail piece. If block 58 decides that the system does not want to cancel, then in of that event the program proceeds to decision block 59 envelope attributes needed by envelope printer process 31 or document printer process 30 (FIG. 1). If block 59 determines that no envelopes attributes are needed then the program proceeds to block 63 FIG. 3B. If decision block 59 determines that envelope attributes are needed, then the program proceeds to decision block 60 "envelope attributes can be sent" (FIG. 3B). If block 60 determines that no envelope attributes can be sent then the program proceeds to block 63. If block 60 determines that envelope attributes can be sent to envelope printer process 31 of FIG. 1, then the program proceeds to block 61 to send the envelope attributes to process 31. Now, the program goes to block 62 to decrement the reserve counter. At this point, the program proceeds to decision block 63 to determine whether or not the reserve counter is greater then the reserve length of queue 13. If block 63 determines that the answer is not, then the program proceeds to block 67 wait, before going back to block 60. If block 63 determines that the answer is yes, then the program proceeds to decision block 64 to determine whether or not printer process 30 of FIG. 1 needs attributes. If block 64 determines that no attributes are needed, then the program proceeds to block 61 wait, before going to block 60. If block 64 determines that attributes are needed, then the program proceeds to decision block 65 to determine whether or not attributes can be sent to process 30 of FIG. 1. If block 65 determines that attributes can not be sent to process 30, then the program proceeds to block 67 wait, before going to block 60. If block 65 determines that attributes can be sent, then the program proceeds to block 66 to send attributes to document printer process 30 of FIG. 1. Now, the program proceeds to block 67 wait, before going to block 60.

Figure 3C:
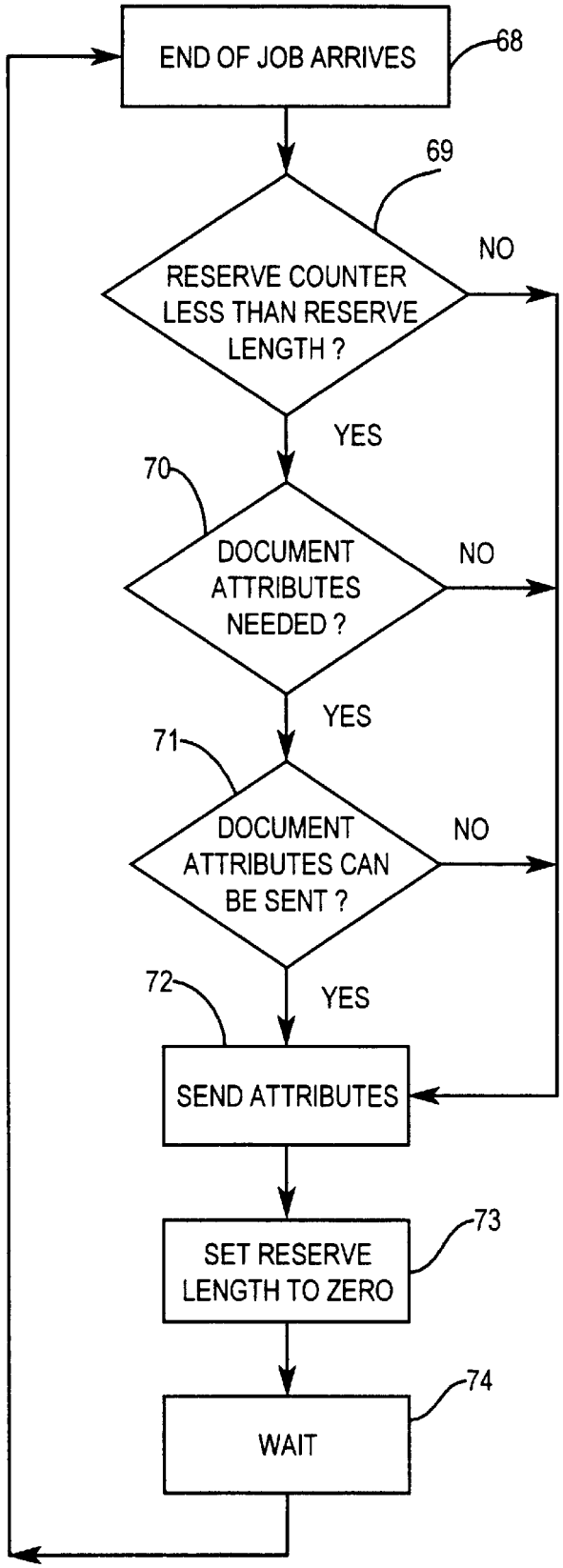
FIG. 3C is a flow chart showing the processing of an end of job.

FIG. 3C is a flow chart showing the processing of an end of job. This subroutine begins in block 68 end of job arrives. In other words the processing of the job is complete. Then, the program proceeds to decision block 69 to determine whether or not the reserve counter is less than the reserve length in queue 13 of FIG. 1. If block 69 determines that the answer is no, then the program proceeds to block 72 send attributes to document printer process 30 of FIG. 1. If block 69 determines that the answer is yes, then the program proceeds to decision block 70 to determine whether attributes are needed in document printer process 30. If block 70 determines that document attributes are needed by process 30, then the program proceeds to decision block 71 to determine whether or not attributes can be sent to process 30. If block 71 determines that attributes cannot be sent, then the program proceeds to block 72 to send the attributes. If block 71 determines that attributes can be sent, then the program proceeds to block 72 to send attributes to document printer process 30. Then, the program proceeds to block 73 to set the reserve length of queue 13 to zero Now, the program goes to block 74 to wait before proceeding back to block 68.

Figure 3D:
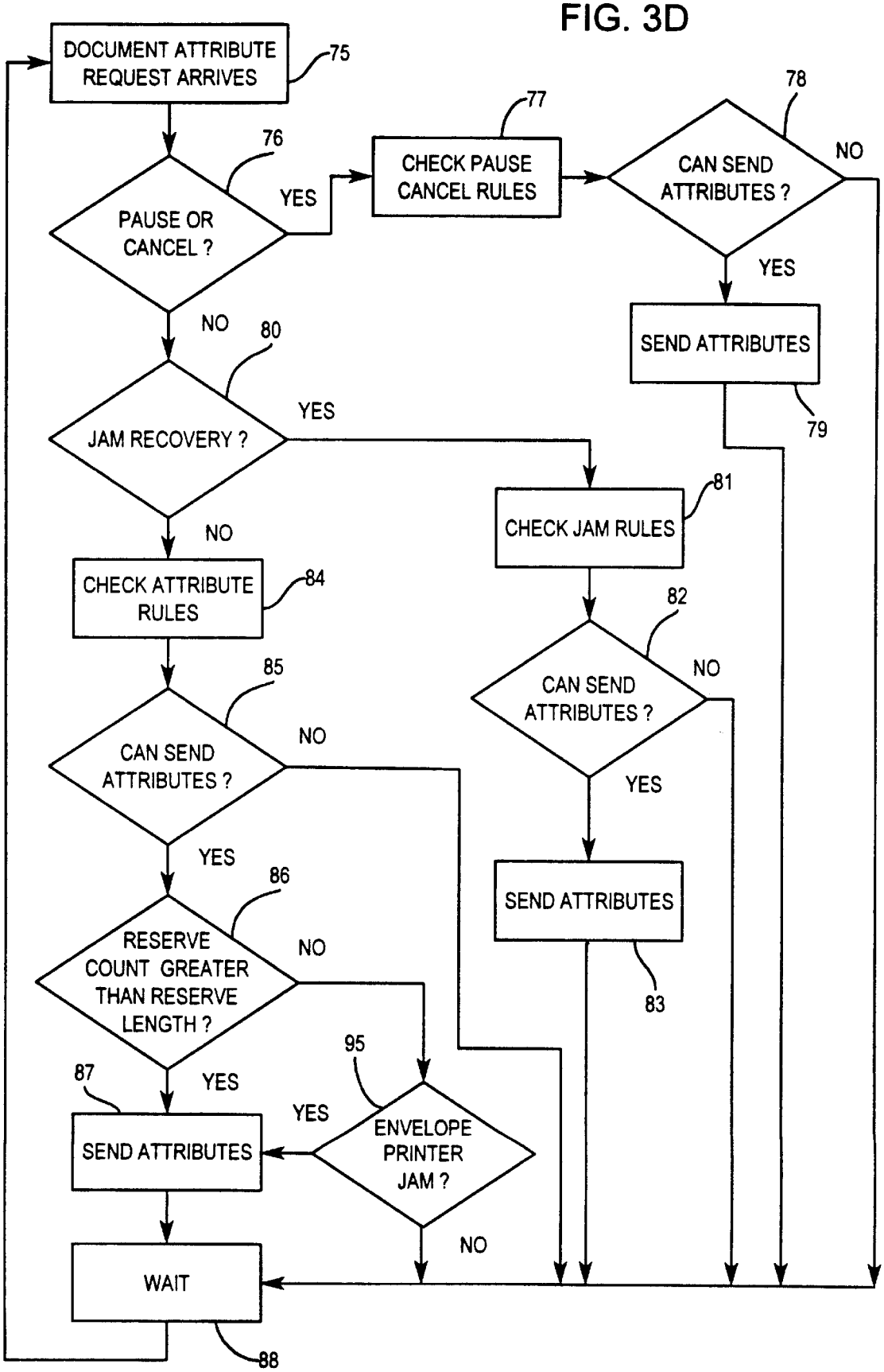
FIG. 3D is a flow chart showing what happens when a request is received from document printer process 30 of FIG. 1.

FIG. 3D is a flow chart showing what happens when a request is received from document printer process 30 of FIG. 1. This subroutine begins in block 75, when a document attribute request arrives i.e., document printer process 30 request attributes. Then, the program proceeds to decision block 76 to determine whether or not to pause or cancel. If block 76 determines that the system wants to pause or cancel, then the program proceeds to block 77 to check the pause and cancel rules. Then, the program proceeds to decision blocks 78 to determine whether or not it can send attributes to document printer process 30 of FIG. 1. If decision block 78 determines that it cannot send attributes to process 30 then it proceeds to block 88 and waits before proceeding to block 75. If decision block 78 determines that it can send attributes to process 30 then it proceeds to block 79 and sends the attributes before advancing to block 88. If decision block 76 determines that the system does not want to pause or cancel then, the program proceeds to decision block 80 jam recovery. If block 80 determines that the system is in a jam recovery mode then, the program proceeds to block 81 to check the jam recovery rules. Now, the program proceeds to decision block 82 to determine whether or not it can send the attributes to process 30. If the attributes cannot be sent to process 30 then and in that event the program proceeds to block 88 and waits before proceeding back to block 75. If block 82 determines that the attributes can be sent then the program proceeds to block 83 to send the attributes to document printer process 30. After sending the attributes to document printer process 30, the program proceeds to block 88 to wait before proceeding back to block 75. If block 80 determines that the system is not in a jam recovery mode, then the program proceeds to block 84 to check the attribute rules. Then, the program proceeds to decision block 85 to determine whether or not it can send the attributes to document printer process 30. If block 85 determines that it cannot send the attributes to process 30, then the program proceeds to block 88 and waits before proceeding back to block 75, If block 85 determines that the attributes can be sent then, the program proceeds to decision block 86 to determine whether or not the reserve count is greater than the reserve length in queue 13 of FIG. 1. If block 86 determined that the answer to the question is no, then the program proceeds to block decision block 95 to determine whether or not the envelope printer 17 is jammed. If printer 17 is jammed the program goes to block decision block 95 to determine whether or not envelope printer 17 is jammed. If printer 17 is jammed program goes to block 87. If printer is not jammed, the program goes to block 88 to wait before proceeding to block 75. If block 86 determines that the answer is yes, then the program proceeds to block 87 to send the attributes to document printer process 30. Now, the program goes to block 88 and waits before proceeding back to block 75.

Figure 3E:
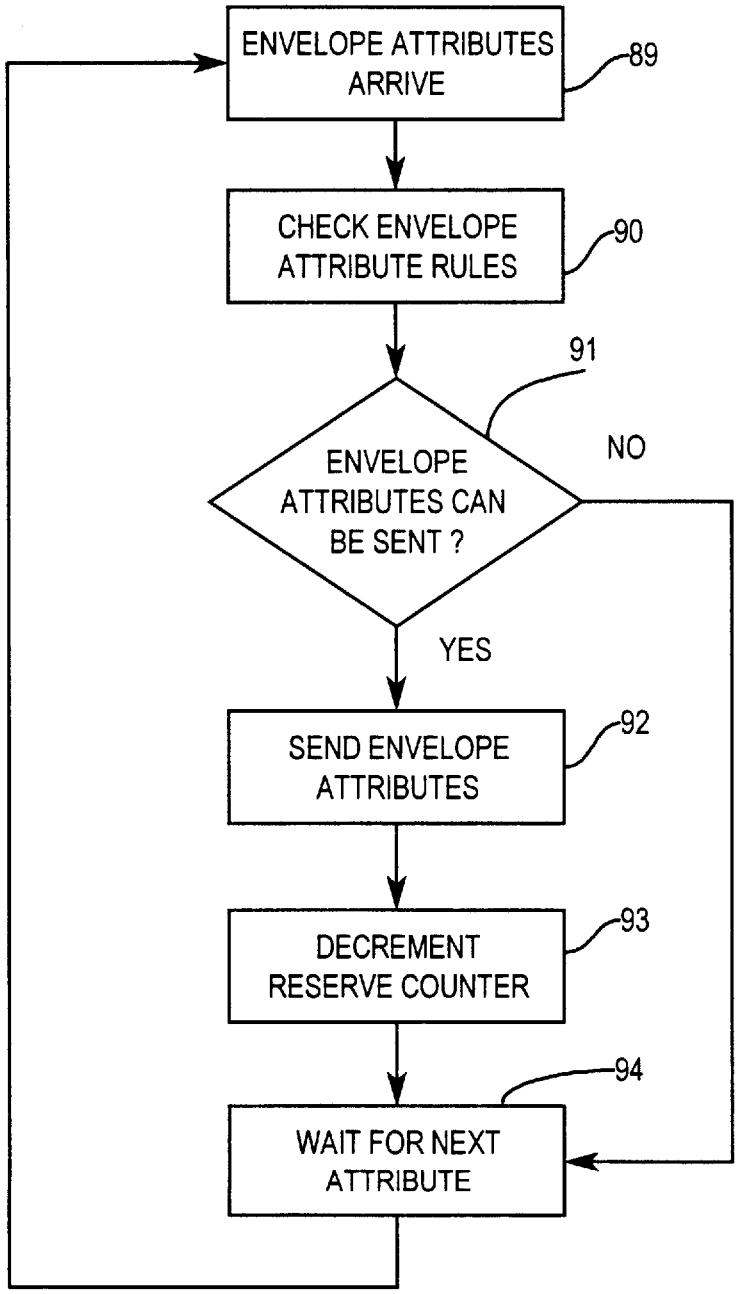
FIG. 3E is a flow chart showing what happens when a request is received from envelope printer process 31 of FIG. 1.

FIG. 3E is a flow chart showing what happens when a request is received from envelope printer process 31 of FIG. 1. This subroutine begins in block 89, when an envelope attributes request arrives from envelope printer process 31 of FIG. 1. Then, the program proceeds to block 90 to check the envelope attributes rules, Now, the program proceeds to decision block 91 to determine whether or not the envelope attributes can be sent to envelope printer process 31 of FIG. 1. If block 91 determines that the attributes cannot be sent to process 31, then the program proceeds to block 94 to wait for the next attribute before proceeding to block 89. If block 91 determines that the attributes can be sent then, the program proceeds to block 92 to send the envelope attributes to envelope printer process 31. Then, the program proceeds to block 93 to decrement the reserve counter. At this point, the program proceeds to block 94 to wait for the next attribute before proceeding back to block 89.

Figure 4A:
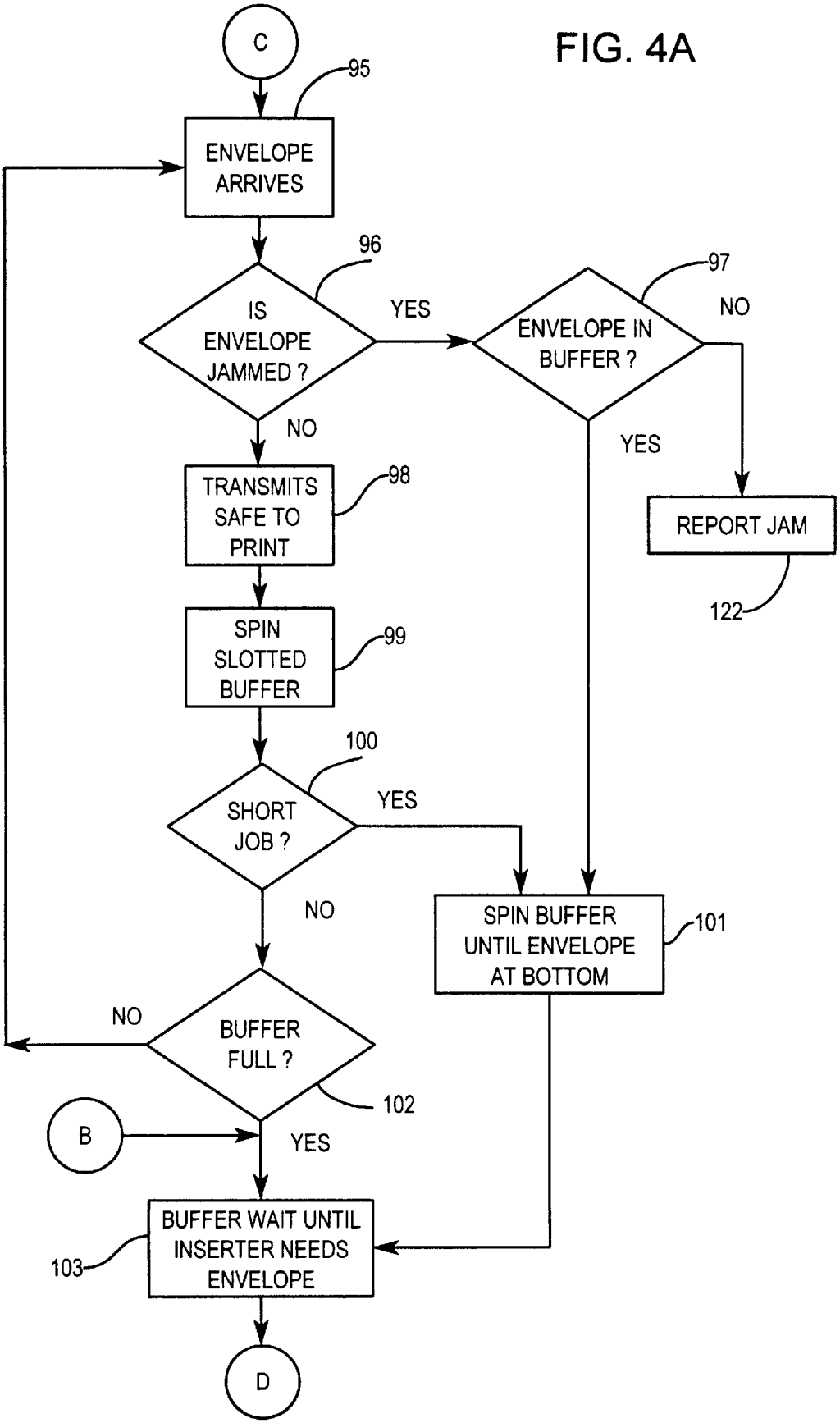
FIGS. 4A and 4B are flow charts showing the program controls slotted buffer 19.
Figure 4B:
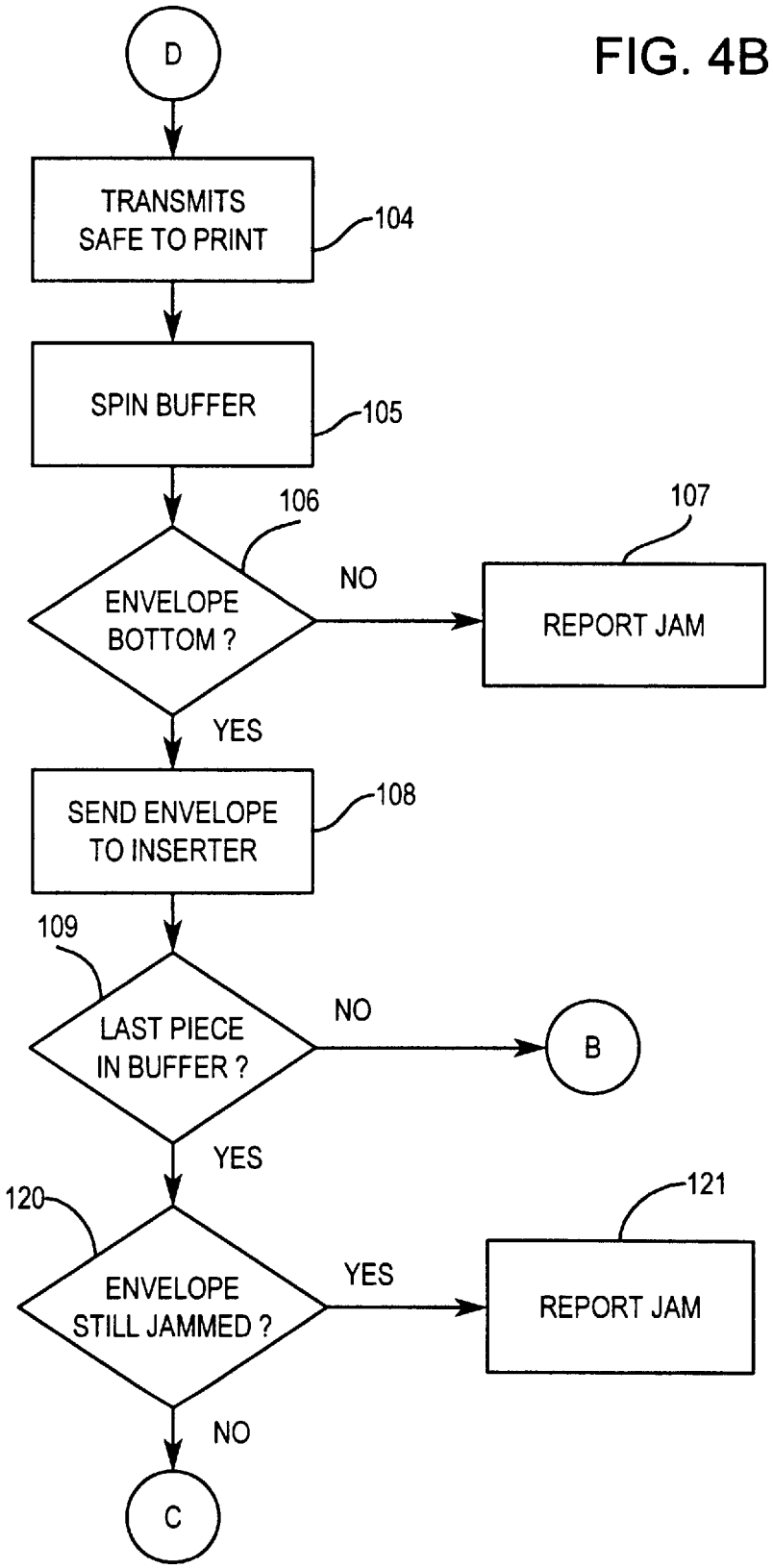

FIGS. 4A and 4B are flow charts showing the program that controls slotted buffer 19. The program begins in block 95 "envelope arrives" at slotted buffer 19. Then the program proceeds to decision block 96 to determine whether or not the envelope is jammed. If the envelope is jammed then in that event the program proceeds to decision block 97 to determine whether or not there are other envelopes in slotted buffer 19. If there are no other envelopes in slotted buffer 19, then the program goes to block 122 to report the jam. If there are other envelopes in slotted buffer 19, then the program proceeds to block 101 "spin buffer" until the envelope at bottom of envelope buffer 19. If block 96 determined that the envelope is not jammed then the program proceeds to block 98 to transmit the next print message to envelope printer process 31. Then, the program proceeds to block 99 to spin slotted buffer 19. Buffer 19 will be spun in accordance with the number of document sheets in the job and the number of slots in buffer 19. Now, the program proceeds to decision block 100 short job. Block 100 determines whether or not there are less than the total number of envelopes that constitutes a full buffer 19. If there are less envelopes than constitutes a full buffer 19, then the program proceeds to block 101 to spin buffer 19 until the envelope is at the bottom of envelope buffer 19. Then, the program proceeds to block 103 to wait until inserter 20 needs an envelope from buffer 19. If decision block 100 determines that there are more than the total number of envelopes that constitute a full buffer 19 then the program proceeds to decision block 102 is buffer 19 full. If block 102 determines that buffer 19 is not full then the program proceeds back to block 95. If decision block 102 determines that buffer 19 is full then the program proceeds to block 103 to wait until inserter 20 needs an envelope from buffer 19. During the start up of this system inserter 20 will need an envelope.

At this juncture the program leaves FIG. 4A and goes to block 104 in FIG. 4B. In block 104 slotted buffer 19 tells printer process 31 to print the next envelope. Now, the program proceeds to block 105 to spin slotted buffer 19. Buffer 19 will be spun in accordance with the number of document sheets in the job and the number of slots in buffer 19. Now, the program goes to decision block 106 to determine whether or not the envelope is at the bottom of slotted buffer 19. If the envelope is not at the bottom of slotted buffer 19 then the program goes to block 107 to report a jam to microprocessor 12. If decision block 106 determines that there is an envelope at the bottom of slotted buffer 19, then the program proceeds to block 108 to send the envelope to inserter 20. Now, the program proceeds to decision block 109 to determine whether or not buffer 19 is empty. If buffer 19 is not empty then the program proceeds to input of block 103 on FIG. 4A. If block 109 determines that buffer 19 is empty then the program proceeds to the input of decision block 120 to determine whether or not the envelope is still jammed. If block 120 determines that the envelope is still jammed, then the program goes to block 121 to report the jam. If block 120 determines that the envelope is not jammed, then the program goes to block 95 on FIG. 4A.

Figure 5:
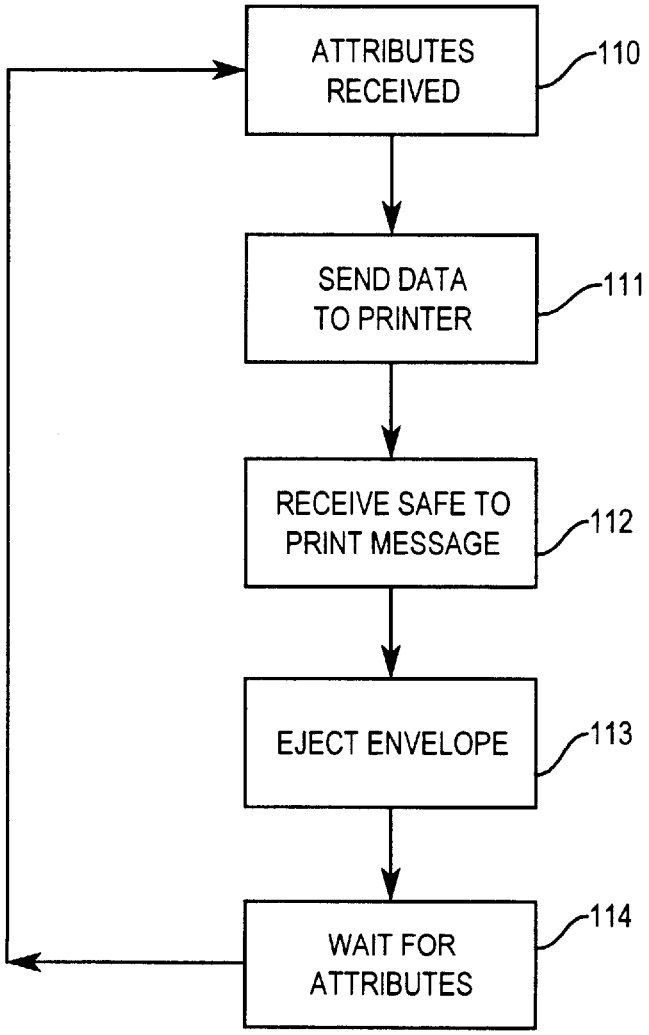
FIG. 5 is a flow chart showing the program contained in envelope printer process 31.

FIG. 5 is a flow chart showing the program contained in printer process 31. The program begins in block 110 attributes received from mailpiece coordinator 12. Then the program goes to block 111 to send data to envelope printer 17. Now, the program goes to block 112 to receive a print message from slotted buffer 19. Then the program goes to block 113 to eject an envelope by sending a form feed to envelope printer 17. Then, the program goes to block 114 to wait for attributes from mailpiece coordinator 12. Then the program proceeds back to block 110.

Figure 6:
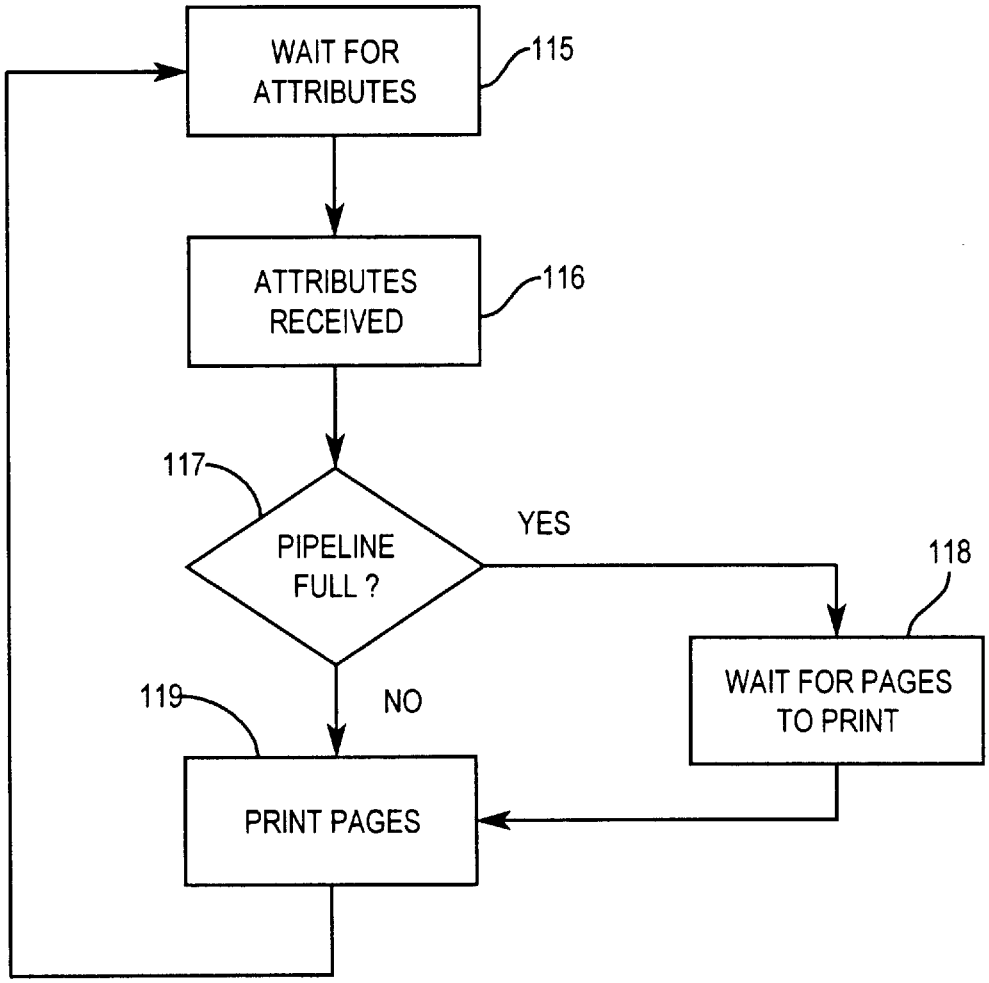
FIG. 6 is a flow chart showing the program contained in document printer process 30.

FIG. 6 is a flow chart showing the program contained in document printer process 30. The program begins in block 115 wait for attributes from counter 12. Then the program proceeds to block 116 to receive the attributes from coordinator 12. Then the program proceeds to decision block 117 to determine whether or not the pipeline is full. If block 117 determines that the system has committed enough pages to keep documents running at full speed then the program proceeds to block 118 to wait for a specified number of pages to be printed that were contained in the previously received attributes. Then, the program proceeds to block 119 to print the pages contained in the attributes. If block 117 determines that the system has not committed enough pages to keep the document running at full speed then, the program proceeds to block 119 to print the pages that were contained in the attributes. After printing the pages the program proceeds back to block 115.

The above specification describes a new and improved synchronizing system that permits material that is being produced at one fixed speed to be synchronized with material that is produced at variable speeds. The foregoing also permits a first document laser printer that has a constant printing time and a second envelope printer that has a variable print time to be synchronized. Thus, the document may be printed with a laser printer and the and the envelope printed with an ink jet printer. It is realized that the above description may indicate to those skilled in the art additional ways in which the principles of this invention may be used without departing from the spirit. It is, therefore, intended that this invention be limited only by the scope of the appended claims.

It is claimed:

1. A system for synchronizing the output of a first document printer that has a variable print time with the output of a second mailpiece printer that has a constant print time, said system comprises:

a mechanical buffer having a plurality of slots for holding the material printed by the first printer, in the order that it was printed;

means coupled to said buffer and the second printer for controlling the output of the second printer so that the printing of the first printer will be synchronized with the printing of the second printer.

2. The system claimed in claim 1 wherein said slots are helically shaped.

3. The system claimed in claim 1, wherein said slots comprises:

a plurality of helically shaped screws that holds materials in the threads of said screws.

4. The system claimed in claim 3, further including:

means for turning said screws one or more threads at a time so that material may exit the threads of said screws while new material is entering the threads of said screws 5. The system claimed in claim 1, wherein said controlling means synchronizes the system by pacing the system with the first or second printer having the slowest output.

6. The system claimed in claim 5, wherein said controlling means synchronizes the system by automatically pacing the system.

7. The system claimed in claim 5, wherein said controlling means synchronizes the system by slowing the output of the first printer or the output of the second printer in a uniform manner.

8. The system claimed in claim 1, wherein said controlling means comprises:

a queue of mailpiece attributes that are stored in a first memory;

a first memory buffer that stores the mailpiece attributes;

a queue of document attributes that are stored in a second memory;

a second memory buffer that stores the document attributes; and means for processing the document attributes and the envelope attributes in order to determine when the attributes will be communicated to the first and second printer.

9. The system claimed in claim 5, wherein said controlling means synchronizes the system by slowing the first and second printer in a synchronized manner to compensate for interruptions in the transfer of data.

10. The system claimed in claim 1, wherein said mechanical buffer is a shift register type buffer.

11. A system for synchronizing the output of a first printer that has a variable print time with the output of a second printer that has a constant print time, said system comprises:

a mechanical buffer that holds material printed by the first printer, in the order that it was printed, wherein said mechanical buffer has a plurality of helically shaped slots in the form of helically shaped screws for holding the material printed by the first printer in the threads of said screws;

means coupled to said buffer and the second printer for controlling the output of the second printer so that the printing of the first printer will be synchronized with the printing of the second printer; and means for turning said screws one or more threads at a time so that material may exit the threads of said screws while new material is entering the threads of said screws, wherein said means for turning comprises:

a gear train coupled to said screws;

a motor coupled to said gear train so that said gear train so that said gear train will turn said screws; and means coupled to said motor for adjusting the revolutions of said screws.

12. The system claimed in claim 11, wherein said means for turning comprises:

a gear train coupled to said screws;

a motor coupled to said gear train so that said gear train will turn said screws; and means coupled to said motor for adjusting the revolutions of said screws.

* * * * *